US010537487B2

(12) United States Patent
Malone

(10) Patent No.: US 10,537,487 B2
(45) **Date of Patent: *Jan. 21, 2020**

(54) METHOD AND APPARATUS FOR KNEE JOINT FLEXIBILITY REHABILITATION

(71) Applicant: Xeras Medical Technologies, Inc., Boerne, TX (US)

(72) Inventor: Mark S. Malone, Boerne, TX (US)

(73) Assignee: XERAS MEDICAL TECHNOLOGIES, INC., Boerne, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/649,167

(22) Filed: Jul. 13, 2017

(65) Prior Publication Data

US 2018/0000679 A1 Jan. 4, 2018

Related U.S. Application Data

(63) Continuation of application No. 14/758,776, filed as application No. PCT/US2015/019336 on Mar. 7, 2015, now Pat. No. 9,962,311.
(Continued)

(51) Int. Cl.
*A61H 1/02* (2006.01)
*A63B 23/04* (2006.01)
*A63B 23/00* (2006.01)

(52) U.S. Cl.
CPC ..... *A61H 1/024* (2013.01); *A63B 23/04* (2013.01); *A61H 2201/0161* (2013.01);
(Continued)

(58) Field of Classification Search
CPC ..... A61H 1/0237; A61H 1/024; A61H 2201/0161; A61H 2201/0192; A61H 2201/164; A61H 2203/045; A61H 2205/102; A61H 2205/104; A63B 21/4047; A63B 21/4011; A63B 23/0494;
(Continued)

(56) References Cited

U.S. PATENT DOCUMENTS 2,819,873 A 1/1958 Peame
3,060,926 A 2/1961 May
(Continued)

FOREIGN PATENT DOCUMENTS

CN 2885222 4/2007

OTHER PUBLICATIONS

Google Patents English translation of Foreign Patent Document 1, CN2885222, translated Jun. 26, 2017 (1 page).
(Continued)

*Primary Examiner* — Joshua Lee
(74) *Attorney, Agent, or Firm* — Pizarro Allen PC

(57) ABSTRACT

Knee joint flexibility rehabilitation apparatuses and methods specifically adapted for knee joint flexibility rehabilitation following knee joint surgery or other type of knee joint treatment are described. In some embodiments, a knee joint flexibility apparatus may include a padded knee posterior support bar disposed atop an adjustable rod and collaborating strut tube. Apparatuses and methods herein may be used to promote gravity passive flexion specific towards gradual knee joint muscle and tendon stretching.

10 Claims, 4 Drawing Sheets

Related U.S. Application Data

(60) Provisional application No. 61/950,276, filed on Mar. 10, 2014.

(52) U.S. Cl.
CPC ..... *A61H 2201/0192* (2013.01); *A61H 2201/164* (2013.01); *A61H 2203/045* (2013.01); *A63B 2023/006* (2013.01)

(58) Field of Classification Search
CPC ..... A63B 2208/0247; A63B 2023/006; A63B 2023/003; A63B 23/02; A63B 23/0216; A63B 23/0227–0238
See application file for complete search history.

(56) References Cited

U.S. PATENT DOCUMENTS 3,203,657 A 8/1965 Thompson
3,415,490 A 12/1968 Steele
3,602,492 A 8/1971 Petrie
3,717,144 A 2/1973 Bimler
4,700,373 A 10/1987 Miller
4,844,454 A 7/1989 Rogers
5,025,802 A 6/1991 Laico et al.
5,074,549 A * 12/1991 Harvey ..... A63B 23/0494 482/105
5,190,513 A * 3/1993 Habing ..... A63B 23/0211 482/140
5,290,209 A * 3/1994 Wilkinson ..... A63B 21/00047 482/121
5,333,604 A 8/1994 Green et al.
5,334,028 A 8/1994 Melligan
5,421,115 A 6/1995 McKay
5,435,411 A 7/1995 Borgatti
5,509,894 A 4/1996 Mason et al.
5,554,088 A 9/1996 Zlojutro
5,722,627 A 3/1998 Hoshino
5,746,688 A * 5/1998 Prager ..... A63B 23/03533 482/130
5,871,457 A 2/1999 Swedberg et al.
5,878,453 A 3/1999 Stokes
5,935,050 A * 8/1999 Shahan ..... A63B 23/0211 482/140
5,971,902 A * 10/1999 Robertson ..... A61H 1/0218 482/142
6,001,051 A * 12/1999 Chuan-Pin ..... A63B 21/0552 482/131
6,030,352 A * 2/2000 Paik ..... A61H 1/0237 482/904
6,048,293 A * 4/2000 Lee ..... A63B 23/0211 482/140
D432,246 S 10/2000 Pestone
6,165,112 A * 12/2000 Morris ..... A63B 21/0552 482/129
6,287,244 B1 * 9/2001 Boos ..... A63B 21/068 482/142
6,309,330 B1 * 10/2001 Thornton ..... A63B 21/00047 482/140
6,371,894 B1 4/2002 Hill
6,569,064 B1 5/2003 Loane
6,595,904 B1 * 7/2003 Staffa ..... A63B 21/0552 482/101
6,991,591 B1 1/2006 Tsatsouline
7,695,416 B2 4/2010 Weiner
7,784,749 B2 8/2010 Radermacher
8,012,047 B2 9/2011 Gamboa
8,425,343 B1 4/2013 Olmos
8,646,731 B2 2/2014 Buries
9,498,399 B1 * 11/2016 Juntunen ..... A61H 1/024
9,907,989 B2 * 3/2018 Louviere ..... A63B 21/06
2003/0130097 A1 7/2003 Harrison
2003/0224880 A1 12/2003 Hansberry
2004/0049135 A1 3/2004 Callanan et al.
2005/0012000 A1 1/2005 Jones
2006/0009336 A1 1/2006 Millet
2006/0217249 A1 * 9/2006 Webber ..... A63B 23/02 482/142
2006/0258516 A1 * 11/2006 Nolte ..... A63B 21/00047 482/92
2007/0298883 A1 12/2007 Feldman et al.
2008/0058173 A1 * 3/2008 Mattox ..... A63B 21/0004 482/92
2008/0182730 A1 7/2008 Conley et al.
2009/0163837 A1 6/2009 Sanger et al.
2009/0275447 A1 11/2009 Fishman et al.
2010/0029449 A1 * 2/2010 Kim ..... A61H 7/001 482/121
2010/0041530 A1 2/2010 Liu
2010/0234192 A1 9/2010 Oller, Jr.
2011/0231995 A1 9/2011 Sedillo
2012/0115693 A1 5/2012 Franques Garcia
2013/0029814 A1 1/2013 D'Alessandro
2013/0110013 A1 * 5/2013 Carlson ..... A61H 1/024 601/5
2013/0197403 A1 8/2013 Sevy et al.
2013/0211297 A1 * 8/2013 Method ..... A61H 1/024 601/34
2013/0225378 A1 * 8/2013 Burek ..... A63B 26/00 482/142
2014/0066271 A1 3/2014 Gray
2014/0073998 A1 * 3/2014 Keiser ..... A63B 21/00185 601/34
2014/0087929 A1 3/2014 Sussman
2014/0094721 A1 4/2014 Diallo
2014/0228186 A1 8/2014 Montgomery

OTHER PUBLICATIONS

"Getting Back Out There," Trainer Rx, http://www.trainer-rx.com, Jun. 20, 2017 (7 pages).

* cited by examiner

METHOD AND APPARATUS FOR KNEE JOINT FLEXIBILITY REHABILITATION

CROSS-REFERENCE TO RELATED APPLICATION

This application is a continuation of U.S. Non-Provisional patent application Ser. No. 14/758,776, entitled "Method and Apparatus for Knee Joint Flexibility Rehabilitation," filed Jun. 30, 2015, which is a '371 U.S. national stage entry application of International Patent Application No. PCT/US2015/019336, entitled "Method and Apparatus for Knee Joint Flexibility Rehabilitation," filed Mar. 7, 2015, which claims priority to U.S. Provisional Patent Application 61/950,276, entitled "Method and Apparatus for Knee Joint Flexibility Rehabilitation," filed Mar. 10, 2014, the disclosures of which are wholly incorporated herein by reference.

FIELD

The disclosed method and apparatus generally relate to physical therapy for knee joints.

BACKGROUND

The anatomy of a knee joint consists of three bones. These three specific bones are the femur (thighbone), the tibia (shinbone) and the patella (kneecap). The patella is located in front of the knee joint, and provides partial protection for the anterior portion of the knee. Typically, bones are connected to other bones through ligaments. Specifically, the knee joint has four ligaments functioning as resilient elastic cables linking the femur and tibia together for the purpose of maintaining knee joint stability.

Collateral ligaments are located vertically on opposed parallel sides of the knee joint. The medial collateral ligament is located on the outer inside of the knee joint, and links the femur and tibia. The lateral collateral ligament is located on the outer outside of the knee joint, and also links the femur and tibia. The purpose of the collateral ligaments is towards controlling knee joint sideways motion, thus fortifying the knee joint against unusual movement.

Cruciate ligaments are located inside of the knee joint, and cross each other in the general form of an "X", the anterior cruciate ligament is located in front, behind the patella, and the posterior cruciate ligament is located in the back, linking the femur and tibia and having a purpose towards controlling anterior and posterior movement of the knee joint.

Upon completion of knee joint surgery or other type of knee joint treatment, such as knee joint replacement or replacement or repair of any torn or damaged previously described ligaments, bone fracture and bone fracture surgery, or internal fixation surgery, or for treatment of arthritic conditions, or meniscus repair, or for knee injury recovery, regaining normal knee joint flexibility, range of motion and strength typically requires a physical therapy rehabilitation program.

Following knee surgery, or arthritic treatment, or injury treatment, or other procedure or course of treatment for the knee joint, physical therapy may be beneficially applied to restoring full and painless motion of the knee joint, along with re-establishing associated ligament and muscle suppleness. Restoration may be followed by a knee joint strengthening program focused on regain normal function of the knee joint. A physical therapy program progressively stretches muscle(s) and tendon(s) to their former flexibility.

A final rehabilitation phase encourages complete return of normal knee joint functionality.

There remains a need for an apparatus and method for knee joint gravity-assist passive flexion.

SUMMARY

A knee joint flexibility rehabilitation apparatus may comprise a tubular strut having a first support foot and a bracket attached thereto, the tubular strut forming a first aperture; a height-adjustment bar translatably and rotatably disposed in the tubular strut, the height-adjustment bar forming a plurality of second apertures extending through the cross-section of the height-adjustment bar; a support bar fixed substantially perpendicularly to the height-adjustment bar, the padded support bar being configured to receive a knee joint posterior; a support strut pivotably connected to the bracket, the support strut having a second support foot attached thereto, the support strut pivotable away from parallel the tubular strut to form an acute angle thereto; and a pin removably disposed in one of the plurality of second apertures to fix the height-adjustment bar against translation in one direction. The pin may be further removably disposed in the first aperture to fix the height-adjustment bar against rotation and translation. The first foot may be substantially perpendicular to the tubular strut, and the second foot may be substantially perpendicular to the support strut. The support bar may be padded. The bracket may be configured to prevent travel of the support strut away from the tubular strut beyond a predetermined angle.

A method of using the foregoing apparatus may comprise the steps of orienting a patient to a supine position upon a substantially level surface; raising the patient's leg; disposing the apparatus under the patient's leg so that the first support foot is adjacent the patient's buttocks, and the tubular member is substantially parallel the thigh of the patient's leg; and translating the height-adjustment bar so that the support bar contacts the posterior knee joint of the patient's leg or approximately thereto; and allowing the lower portion of the patient's leg to extend past the support bar in cantilever fashion so as to permit a gravitational force on the lower portion to promote rehabilitation of the knee joint. The method may further comprise the step of inserting the pin into one of the plurality of second apertures so as to prevent translation of the height-adjustment bar toward the table. The method may further comprise the step of inserting the pin into the first aperture and into one of the plurality of second apertures so as to prevent translation and rotation of the height-adjustment bar.

DETAILED DESCRIPTION

Figure 1:
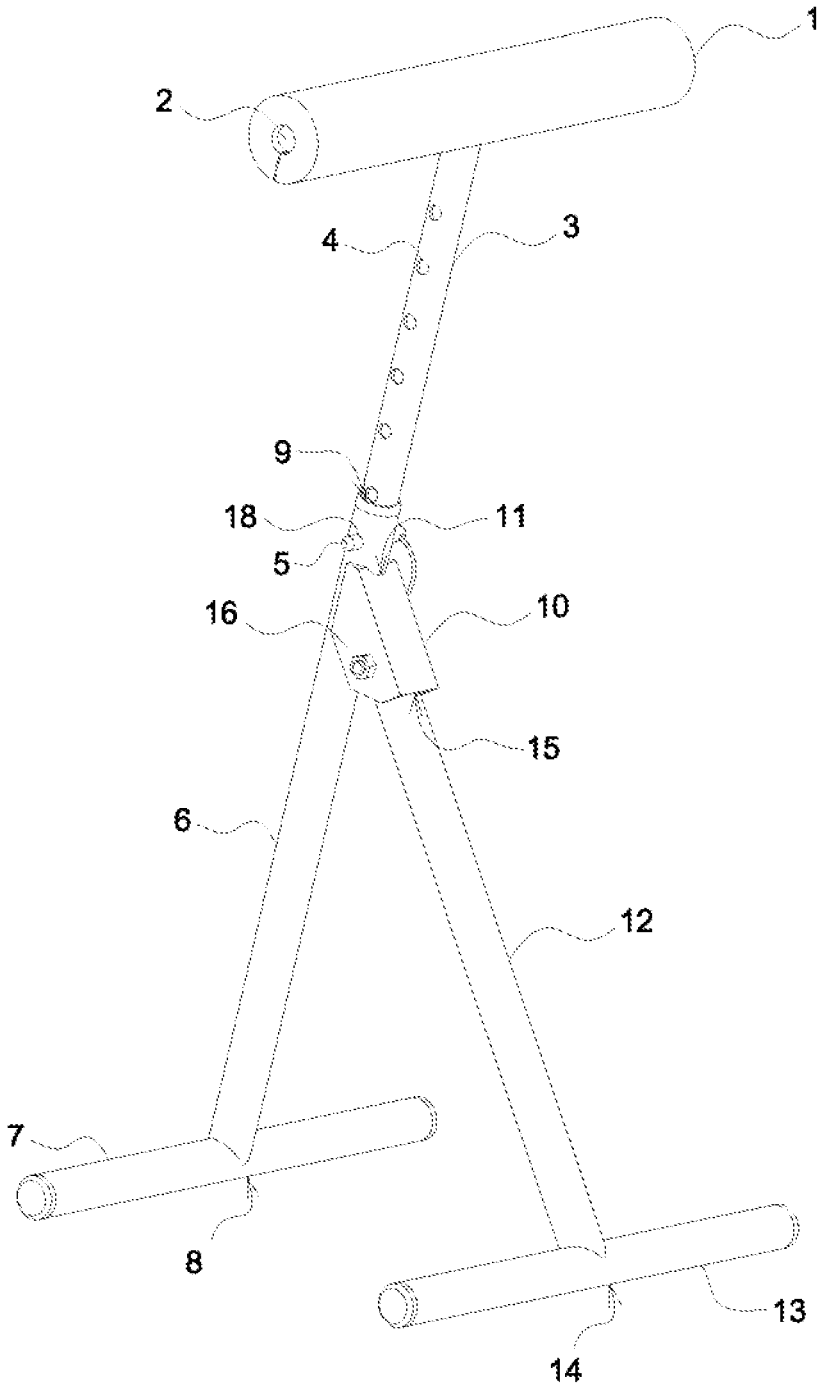
FIG. 1 provides a perspective view of one embodiment of an apparatus for knee joint flexibility rehabilitation.

Disclosed is a passive manipulative knee joint flexibility therapy apparatus and method, specifically adapted for knee joint flexibility rehabilitation following knee joint surgery or other type of knee joint treatment, such as knee joint replacement or replacement or repair of any torn or damaged previously described ligaments, bone fracture and bone fracture surgery, or internal fixation surgery, or for treatment of arthritic conditions, or meniscus repair, or for knee injury recovery, regaining normal knee joint flexibility, range of motion and strength. The apparatus capable of reducing muscle spasm, pain and swelling; having such arrangement to provide appropriate content stable support of the posterior intersection concerning the femur and tibia of a non-operative, arthritic, injured, fractured, or post-operative recovering knee joint; prompting deliberate gravity assisted passive flexion towards gradual knee joint muscle and tendon stretching, and mechanical decompression of the knee joint to alleviate pain, pressure, swelling, and general discomfort.

The disclosed apparatus arrangement may comprise a padded knee posterior support bar disposed atop an adjustable linearly sliding rod; whereby said rod may travel a controlled distance while contained inside a slightly larger collaborating support strut tube. A locking mechanism may be used, thereby establishing and maintaining a desired height position of the posterior knee support bar. Further, the disclosed apparatus may utilize opposed parallel horizontal members as stabilizing structure; being estranged, such members may form a stable apparatus foundation; having each support base tube incorporate a perpendicular strut affixed mid span; uniting the opposing strut ends uniquely via a pivot fulcrum point; forming a triangle. Further, the apparatus is collapsible to a somewhat flat arrangement for easy of storage or shipment.

The above brief description sets forth rather broadly certain features of the disclosed apparatus in order that the description thereof that follows may be better understood, and in order that the present contributions to the art may be better appreciated. There are, of course, additional features of the disclosed apparatus that will be described hereinafter and which will, in whole or in part, form the subject matter of the claims appended hereto.

Thus, it is to be understood that the disclosed subject matter is not limited in its application to the details of the construction and to the arrangements of the components set forth in the following description or illustrated in the drawings. The disclosed subject matter is capable of other embodiments and of being practiced and carried out in various ways, including being fabricated with fixed dimensions, non-folding components, or other structural locking mechanisms. Also, it is to be understood, that the phraseology and terminology employed herein are for the purpose of description and should not be regarded as limiting.

As such, the concept, upon which this disclosure is based, may readily be utilized as a basis for designing other structures, methods, and systems for carrying out several purposes of the present invention. It is important, therefore, that the claims be regarded as including such equivalent constructions insofar as they do not depart from the spirit and scope of the subject matter described herein.

Various objectives may be therefore apprehended, one or more of which the disclosed subject matter may provide:

One objective may be to provide a new and unique economically realized passive knee joint flexibility rehabilitation apparatus wherein the various elements of the apparatus may be examined.

Another objective may be knee joint flexibility rehabilitation.

Another objective may be knee joint strengthening rehabilitation.

Another objective may be reduction of spasm(s) of the knee joint musculature.

Another objective may be knee joint pain reduction.

Another objective may be knee joint swelling reduction.

Another objective may be to provide such an arrangement for which to appropriately and contentedly support the posterior intersection relationship of the femur and tibia allowing for knee joint decompression.

Another objective may be to promote gravity assisted passive flexion specific towards gradual knee joint muscle and tendon stretching.

Another objective may be to provide a padded horizontal posterior knee support bar; where a pad could be realized from such material as neoprene, polysulfide, silicone, urethane, gel, but not limited thereto; where the horizontal knee posterior support bar may have a predetermined length and have rounded ends.

Another objective may be mechanically affix a padded horizontal knee posterior support bar, and provide proper longitudinal position relative to individual recovering patient knee anatomy during gravity assisted passive flexion.

Another objective may be to provide the opposed end of said adjustable sliding rod strut tube to be perpendicularly introduced in to a somewhat larger diameter horizontal tube; considered as a base foot; being realized from such material as ferrous or nonferrous metal, plastic, wood, carbon fiber, composite, fiberglass, but not limited thereto; with said tube incorporating a purposefully predetermined receiving hole or harbor mid span; being somewhat dimensionally reduced of that of the strut tube outer wall dimension; wherein the strut tube end being firmly pressed in to the accommodating receiving harbor; having this press fit amalgamation permanently affixed by means of mechanical, fusion or chemical bonding, but not limited thereto.

Another objective may be to provide said adjustable sliding rod strut tube as being perpendicularly introduced in to said horizontal tube base foot; to include a dual purpose mounting bracket located an established distance below said adjustable sliding rod entry; being located 90 degrees in reference to said horizontal tube base foot; whereas said mounting bracket appendage may be angled at a somewhat 4 o'clock position; being permanently affixed mechanically, chemically, or fusion bonded, but not limited to; with said mounting bracket realized from such material as ferrous or nonferrous metal, plastic, wood, carbon fiber, composite, fiberglass, but not limited thereto; having said mounting bracket realized by means of casting, forming, molding, fabricating, stamping, machining, but not limited thereto.

Another objective may be to provide said permanently affixed mounting bracket as being a predetermine length; having a profile with an inside dimension equaling that of a cooperating second strut tube outside dimension, in which such profile may comprise a square channel profile; with the channel opening positioned facing downward towards said horizontal tube base foot; incorporating laterally opposed apertures located at identical predetermined points aside said square channel.

Another objective may be to provide a second said strut tube being a predetermined length perpendicularly introduced in to a second somewhat larger diameter horizontal tube; considered as a base foot, realized from such material as ferrous or nonferrous metal, plastic, wood, carbon fiber, composite, fiberglass, but not limited thereto; having said horizontal tube base foot incorporate a purposefully predetermined receiving hole or harbor mid span; being somewhat dimensionally reduced to that of the said second strut tube outer wall dimension; wherein the strut tube end being firmly pressed in to the accommodating receiving harbor; having this press fit amalgamation permanently affixed by means of mechanical, fusion or chemical bonding, but not limited thereto.

Another objective may be to provide the second said strut tube being perpendicularly introduced and permanently affixed to the somewhat larger diameter tube; considered as a base foot; having the opposing strut tube end include laterally opposed apertures equal to the diameter of the apertures referenced in said dual purpose mounting bracket; having said apertures located parallel considering said base foot horizontal relationship.

Another objective may be to provide the second said strut tube; having the opposing end include laterally opposed apertures; incorporate an arc end; whereas the arc chord equaling said strut tube outside diameter; whereby arc height and outside tube radius being equivalent; having said arc chord midpoint being the same as of said opposed aperture centers.

Another objective may be to provide the adjustable sliding strut tube and second strut tube compilation, having an arc end, as united by inserting the arc end of said second strut tube into the accommodating dual purpose channel shaped said mounting bracket; wherein once inserted alignment of the cooperating said laterally opposed cooperating of each component, may align, thus affording the insertion of a bolt, screw, or pin, but not limited to; being realized as a pivot fulcrum.

Another objective may be to provide the adjustable sliding strut and the second strut compilation as utilizing said pivot fulcrum the second strut compilation to swing into a somewhat flat collapsed configuration, whereas the strut feet are in close horizontal parallel proximity.

Another objective may be to capitalize upon pivot fulcrum utilization, whereby spreading the strut support feet a predetermined distance; having that distance governed by rigid contact interface between the pivoting strut tube outer surface engaging the internal top surface of the affixed said dual purpose mounting bracket channel; whereby realizing a stable acute triangle support frame structure.

Another objective may be to provide a new knee joint gravity assisted passive flexion apparatus, which may be easily and efficiently manufactured and marketed.

Another objective may be to provide knee joint gravity assisted passive flexion apparatus, which is of durable and reliable construction.

Another objective may be to provide a new knee joint gravity assisted passive flexion apparatus, which may be susceptible of a low cost of manufacture with regard to both materials and labor, and which accordingly may then be susceptible of low prices of sale to the consuming public, thereby making such knee joint gravity assisted passive flexion assembly available to the buying public.

With reference now to the drawings, a novel and unique apparatus for knee joint flexibility and rehabilitation will be more fully disclosed. Such an apparatus, and method of using such apparatus, may meet one or more of the foregoing objectives. FIG. 1 provides a perspective view of an embodiment of such an apparatus. The apparatus may have a supple pad 1 encompassing nearly the full length of a knee posterior support bar 2, but not necessarily in full circumference; having said pad 1 feasibly detained, by some form of bonding agent (e.g., glue, double-sided tape, stitching, Velcro, or some other commercially available attachment means) or simply by friction or mechanical pressure. The knee posterior support bar may be substantially horizontally oriented. The bar 2 and a linearly travelling adjustable rod 3 may be mechanically joined. Said linearly travelling rod 3 may contain one or more holes 4 which may be used to lock the rod 3 in vertical position with a pin 5 or any other suitable locking mechanism.

A sliding bar strut tube 6 may serve as a structural support component affixed to horizontal strut support tube foot 7, for example, at mid span juncture 8, or at an end of the support tube foot 7. Said strut tube 6 may also serve as the housing in which said sliding rod or bar 3 may translate a determined linear distance, upon having said sliding rod 3 inserted into said tube housing 6 at induction point 9. Finally, the sliding bar strut tube housing 6 may have affixed thereto a multi-task bracket 10. The bracket 10 may be located below said induction point 9, such as at reference point 11, and may be disposed at angle to strut support tube foot 7.

Said rod 3 may freely rotate in said strut tube 6. In some embodiments, the rod 3 may be fixed against rotation by insert the pin 5 through a hole 18 in the strut tube 6 and further inserted into one of the holes 4 aligned therewith. Such fixation may further prevent translation of the rod 3.

The pivotal support strut tube 12 may serve as a structural support member affixed to horizontal strut support tub de foot 13, such as at mid-span juncture 14. The opposite end of said strut tube 12 may be introduced into the accommodating landing 15 of said bracket 10. Such introduction may be fixed or pivotable. A pivotable introduction may be accommodated by a pivot point, such as provision of a pivot pin inserted, indicated by reference 16. Thereby having the two collaborate opposing horizontal strut support tube feet 7 & 12 spread apart, utilizing the indicated pivot point 16, to where the pivotal support strut tube 12 engages the multi-task bracket 10 at intended engagement landing point 15, may provide a stable, rigid, gravity assisted passive flexion knee joint flexibility rehabilitation posterior support apparatus.

Figure 2:
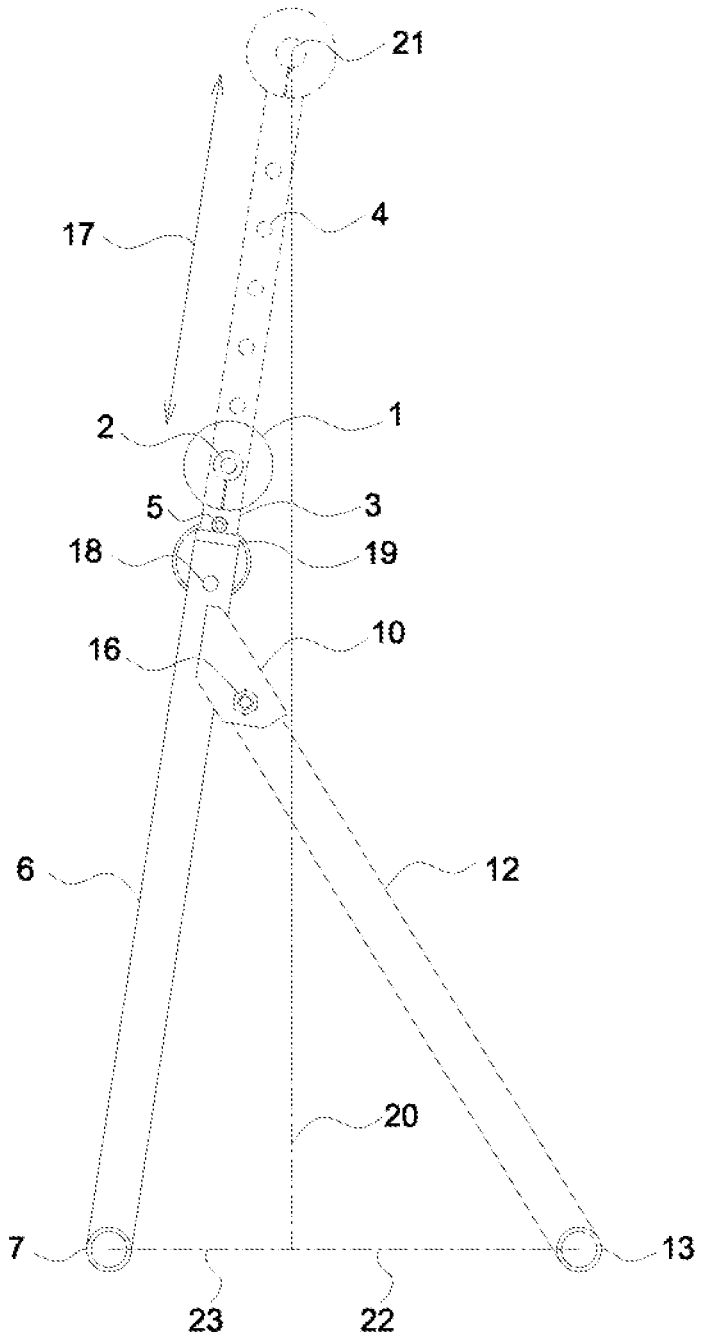
FIG. 2 provides a side elevation view of the embodiment of FIG. 1, revealing a triangular support frame structure, padded horizontal knee posterior support bar, and adjustable linear travel capability.
Figure 3:
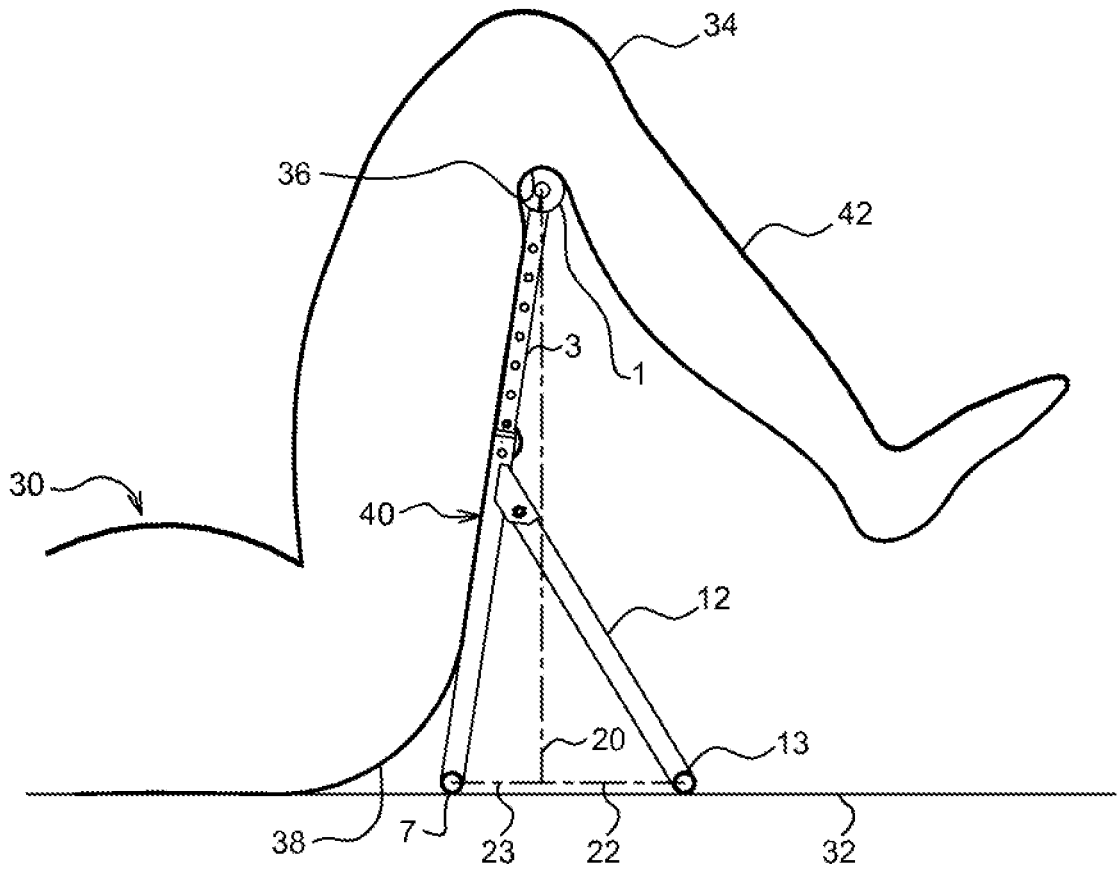
FIG. 3 illustrates a method of using the embodiment of FIG. 2 with the apparatus disposed on a substantially level patient support surface and oriented in a substantially vertical orientation with a patient's knee supported thereon.

FIG. 2 illustrates two exemplary vertical positions of the support bar 2. An exemplary method of using the apparatus of FIG. 1 is described in connection with discussion of FIGS. 2 and 3. A recovering patient 30 may be place in a supine position atop a physical therapy treatment table 32, or other such firm stable surface, whereby having the patient may optionally bend the non-rehabilitating leg at an upward directed 45 degree angle with their foot flatly placed or may optionally have the non-rehabilitating leg resting at full horizontal extension. Thereupon, introducing the apparatus for knee joint flexibility rehabilitation, being approximately centered beneath the recovering knee 34 posterior 36; whereby the strut support tube foot 7 may impinge upon or be disposed on the table adjacent the patient's buttock(s) 38; whereby the compilation of the sliding bar strut tube housing 6 and the linearly traveling adjustable sliding rod 3 may slightly engage the back of the patient's lower thigh 40; whereby encouraging the lower leg thigh to mimic the compilation's acute angle. The patient's recovering knee joint 34 posterior 36 may then rest upon the horizontal knee posterior support bar 2, having the desired height of said support bar 2 established. Accommodating a desired height of said support bar 2 may be accomplished by removing locking pin 5, thus affording said sliding rod 3 free linear movement 17 in either an ascending or descending direction. Reengagement of the locking pin 5 may be accomplished by aligning rod 3 hole 4 with support 6 hole 18 and inserting said locking pin 5. Of course, if both of a patient's knee joints require rehabilitation, two such apparatuses may be advantageously used at the same time. In other embodiments, the support bar 2 may be of a length sufficient to support both of a patient's knee joints, and more than one rod 3 and more than one strut tube 6 may be used to support a single support bar, or more than one support bars 2 in an apparatus.

Should free rotating motion of the sliding rod 3 be desired, the locking pin 5 may be inserted in the appropriate hole 4 of rod 3 above support ring 19, whereby the vertical load of the 30 patient's leg may be transmitted through the locking pin 5 to the top of the support ring 19. The linearly traveling adjustable sliding rod 3 being so disposed, the knee posterior support bar 2 may be temporarily in parallel with opposing horizontal strut support tube feet 7 & 13, respectively. The patient's lower leg 42 may now be extended out over the horizontal knee posterior support bar 2, whereby said support bar 2 may serve as a fulcrum. The compilation engagement of the pivot support strut tube 12, and sliding bar strut tube housing 6 multi-task bracket 10; utilizing a pivot pin, referenced as 16, may have said strut tube 12 in cantilever; thereby establishing an acute angle support structure. Further, considering a phantom centerline 20 commencing from the center of the knee posterior support bar 2 end 21; traveling vertically downward ceasing imaginarily between the opposing horizontal strut support tube feet 7 & 13, simulating opposing right angles having said centerline 20 as the adjacent; revealing said tube foot 13 opposite angle line 22 extends further forward than does opposite angle line 23 of said tube 7. Having this acute triangle configuration may beneficially negate any forward catapulting or pitching effect that could be realized during gravity assisted passive flexion of a knee joint. Now, again, referencing FIG. 1 one may compare the length of the horizontal knee posterior support bar 2 to that the length of the horizontal strut support tube feet 7 & 13, the length of the horizontal strut support tube feet 7 & 13 being equivalent or longer so as to reduce any involuntary lateral or rolling movement of the horizontal knee posterior support bar 2.

Figure 4:
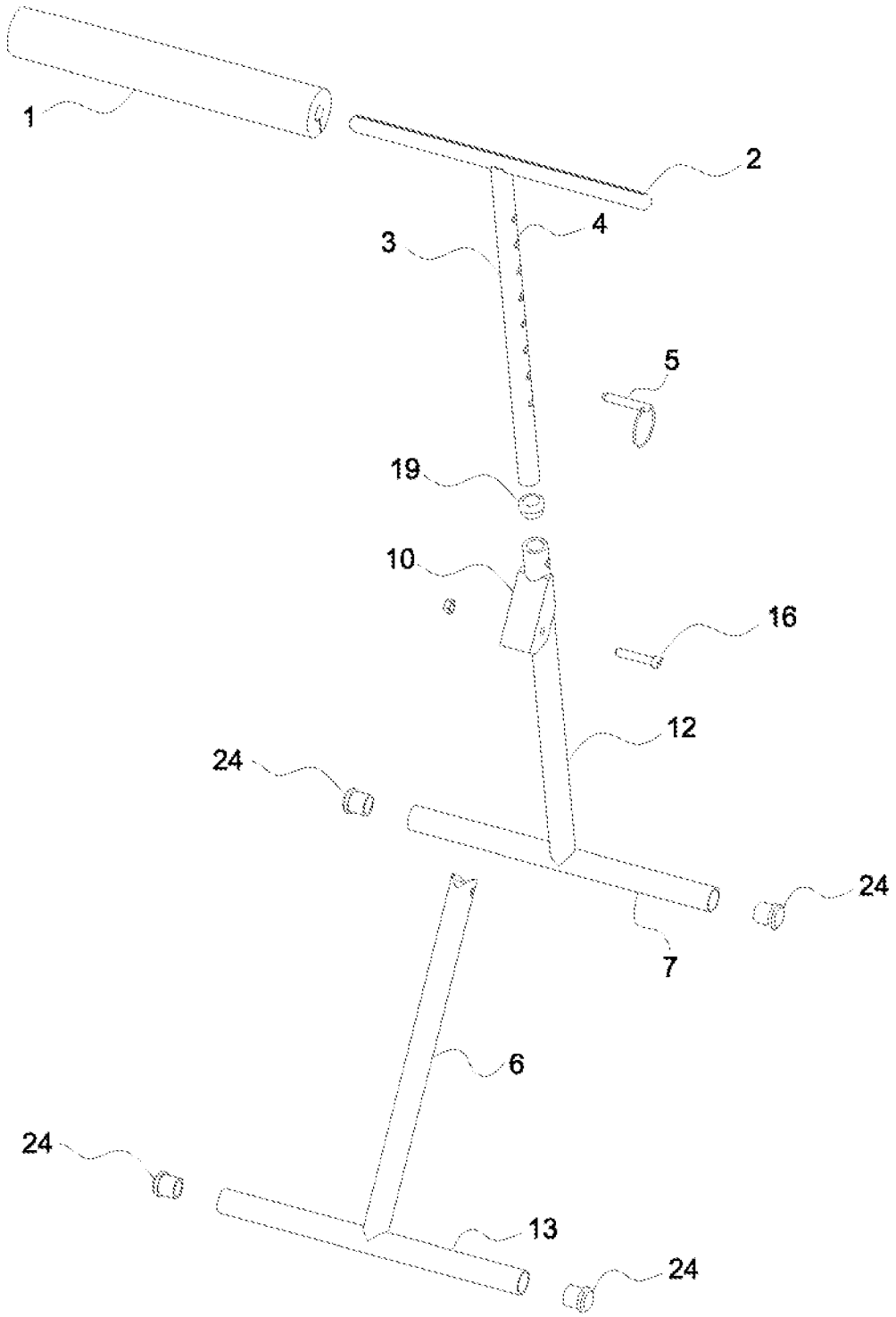
FIG. 4 provides an exploded view of the apparatus of FIG. 1.

Continuing on with FIG. 4 being an exploded illustration of the embodiment of FIG. 1, an end cap 24 may be inserted into each end of supports 7 and 13 respectively. The strut and support tubes, rods and/or bars may comprise any suitable cross-sectional configuration, such as round, square, polygonal, channel, angular or the like. The feet may comprise tubular, angular, channel or plate structural members.

The foregoing thus describes a new knee joint flexibility rehabilitation apparatus. The knee joint flexibility rehabilitation apparatus may be specifically intended for gravity assisted passive flexion of the knee joint. The knee joint flexibility rehabilitation apparatus may be used to provide knee rehabilitation treatment specific for knee joint stiffness, flexibility and strengthening. The knee joint flexibility rehabilitation may be used to provide knee rehabilitation treatment specific for swelling reduction, pain reduction, spasm reduction, and compression reduction. The knee joint flexibility rehabilitation apparatus may be used to provide knee rehabilitation treatment specific for injury recovery, arthritic relief therapy, bone fracture recovery and surgery recovery. The knee joint flexibility rehabilitation apparatus may provide an arrangement that is appropriate for and contently supports the posterior intersection relationship of the femur and tibia of a post-operative recovering knee joint others. The knee joint flexibility rehabilitation apparatus may promote deliberate gravity assist passive flexion specific towards gradual knee joint decompression and muscular and tendon stretching.

Although the disclosed subject matter and its advantages have been described in detail, it should be understood that various changes, substitutions and alterations can be made herein without departing from the invention as defined by the appended claims. Moreover, the scope of the claimed subject matter is not intended to be limited to the particular embodiments of the process, machine, manufacture, composition, or matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods or steps.

I claim:

1. A knee joint flexibility rehabilitation apparatus comprising:

an adjustable strut comprising a rod and a strut tube adjustably coupled thereto, the strut having a first end and a second end with the rod and the strut tube extending therebetween, the adjustable strut having a long axis extending between the first end and the second end, the adjustable strut being adjustable so as to change a distance between the first end and the second end;

a first support foot rigidly mounted substantially perpendicularly to the second end of the adjustable strut, the first support foot being configured to engage a substantially level patient support surface;

an elongate padded support bar configured to receive a knee joint posterior when the first support foot engages said substantially level patient support structure and the adjustable strut is in substantially vertical orientation, the padded support bar being substantially perpendicularly mounted to the first end of the adjustable strut, the padded support bar being rotatable with respect to the first support foot about the long axis of the adjustable strut, the padded support bar being further movable toward or away from the support foot by adjustment of the distance between the first end and the second end of the adjustable strut.

2. The apparatus of claim 1 further comprising a second support foot, the second support foot connected to said adjustable strut and estranged from said first support foot in order to form a stable foundation for said apparatus when the apparatuses is oriented in said substantially vertical orientation.

3. A method of knee joint flexibility rehabilitation, the method comprising:

orienting a patient to a supine position upon a substantially level surface;

raising the patient's leg;

disposing under the patient's leg a knee joint flexibility rehabilitation apparatus comprising:

an adjustable strut including a rod and a strut tube adjustably coupled thereto, the adjustable strut having a first end and a second end with the rod and the strut tube extending therebetween, the adjustable strut having a long axis extending between the first end and the second end, the adjustable strut being adjustable so as to change a distance between the first end and the second end;

a first support foot rigidly mounted substantially perpendicularly to the second end of the adjustable strut, the first support foot being configured for engagement of a substantially level patient support surface; and an elongate padded support bar configured to receive a knee joint posterior when the first support foot engages said substantially level surface and the adjustable strut is supported in substantially vertical orientation, the padded support bar being substantially perpendicularly mounted to the first end of the adjustable strut, the padded support bar being rotatable with respect to the first support foot about the long axis of the adjustable strut, the padded support bar being further movable toward or away from the first support foot by adjustment of the distance between the first and the second end of the adjustable strut;

adjusting the padded support bar toward or away from the support foot so as to permit the posterior of the knee joint of the patient's raised leg to rest on the padded support bar while allowing the lower portion of the patient's leg to extend past the support bar in cantilever fashion so as to permit a gravitational force on the lower portion to promote rehabilitation of the knee joint; and with the posterior of the knee joint of the patient's raised leg maintaining contact with the padded support bar, raising and lowering the lower portion of the patient's leg so as to promote increased range of motion of such knee joint.

4. The method of claim 3 further comprising, with the posterior of the knee joint of the patient's raised leg resting on the padded support bar, moving the lower portion of the patient's leg such that the padded support bar rotates with respect to the support foot.

5. A knee joint flexibility rehabilitation apparatus comprising:

a tubular main strut having a main strut foot configured for engaging a patient support surface;

a height-adjustment bar translatably disposed in the tubular main strut, the height-adjustment bar having a plurality of first apertures extending therethrough;

a padded knee-joint support bar fixed to the height-adjustment bar, the padded knee-joint support bar being configured to receive a knee joint posterior;

a support strut pivotably coupled to the tubular main strut, the support strut pivotable away from a first position in which the support strut is parallel to the tubular main strut to a second position in which the support strut forms an acute angle with respect to the tubular main strut, the support strut having a support strut foot configured for engaging the patient support surface when said main strut foot is also engaging the patient support surface and when the support strut is pivoted to said second position; and a pin removably disposable in one of the plurality of first apertures to fix the height-adjustment bar against translation with respect to the tubular main strut when the knee joint posterior is disposed on the knee-joint support bar.

6. The apparatus of claim 5, the pin being further removably disposed in one of the plurality of first apertures to fix the height-adjustment bar against rotation with respect to the tubular main strut.

7. The apparatus of claim 5, wherein the pivotable coupling prevents travel of the support strut away from the tubular strut beyond a predetermined angle.

8. The apparatus of claim 7, wherein the main strut foot is substantially perpendicular to the tubular main strut, and the support strut foot is substantially perpendicular to the support strut.

9. The apparatus of claim 5, the tubular main strut forming a second aperture, the pin being removably disposable in the second aperture and one of the plurality of first apertures.

10. The apparatus of claim 9, the pin being further removably disposed in one of the plurality of first apertures to fix the height-adjustment bar against translation with respect to the tubular main strut.

* * * * *